United States Patent [19]

Steinhilber

[11] Patent Number: 4,918,809

[45] Date of Patent: Apr. 24, 1990

[54] NAIL MAKING MACHINE

[76] Inventor: Wilhelm A. Steinhilber, 124 White Birch Dr., Guilford, Conn. 06437

[21] Appl. No.: 134,944

[22] Filed: Dec. 18, 1987

[51] Int. Cl.[5] ..... B21G 3/20

[52] U.S. Cl. ..... 29/792; 10/52

[58] Field of Search ..... 10/43, 44, 49, 50, 52, 10/53, 162 R, 169, 54; 29/792, 793, 700; 156/379.8, 538, 539

[56] References Cited

U.S. PATENT DOCUMENTS

| | | | |
|---|---|---|---|
| 364,119 | 5/1887 | Lewis | 10/52 |
| 1,175,567 | 3/1916 | Sleeper | 10/52 |
| 1,647,830 | 11/1927 | Humphris | 10/52 |
| 1,888,610 | 11/1932 | Trott | 10/43 |
| 3,162,871 | 12/1964 | Powers | 10/54 |
| 3,491,389 | 1/1970 | Leistner | 10/162 R |

FOREIGN PATENT DOCUMENTS

| | | | |
|---|---|---|---|
| 30588 | 7/1926 | France | 10/50 |
| 476786 | 2/1980 | U.S.S.R. | 10/52 |

*Primary Examiner*—E. Michael Combs

*Attorney, Agent, or Firm*—McCormick, Paulding & Huber

[57] ABSTRACT

A nail making machine having a capstan for delivering wire to feed rolls which intermittently advance an end portion of the wire to a first workstation where a pointed nail blank is formed and severed from the wire. An indexing wheel conveys successively formed nail blanks to a diametrically opposed second workstation where each blank is headed. Finished nails are delivered by the indexing wheel to a track in collated side-by-side relation to each other where a cleaning operation is performed.

29 Claims, 5 Drawing Sheets

NAIL MAKING MACHINE

BACKGROUND OF THE INVENTION

This invention relates in general to nail making apparatus and deals more particularly with an improved machine for making wire nails.

Machines of the aforedescribed type heretofore available generally include a wire feeding mechanism for intermittently advancing an end portion of an axially elongated wire in an axial direction to a point of operation where the wire is gripped and held in spaced relation to its end by opposing jaws while a reciprocally movable crank driven ram strikes a blow to the projecting end of the wire to form a nail head thereon. During the return stroke of the ram the wire gripping jaws open to release the wire which is further advanced by the wire feeding mechanism. Before the ram completes its return stroke, a pair of opposing cutting and pointing tools move into engagement with opposite sides of the wire to form a nail point on the wire to finish a nail and simultaneously sever the finished nail from the wire. It is necessary that the stroke of the ram be somewhat greater than the length of a finished nail to accommodate the tooling required to perform the nail pointing and severing operation.

The finished nail, which drops from the machine, may be guided into a container by a chute or the like. Preferably, a sweeping mechanism is provided which moves through the region between the gripping jaws and the ram after each nail is formed to assure that the finished nail has cleared the path of the returning ram. Since both the heading and the pointing and severing operations are performed at the same workstation, metal chips produced by the severing or cutting off operation will drop into the container with the finished nails and must be separated from the nails by a further tumbling operation or the like.

The relatively long stroke of the ram coupled with the high inertia developed by the ram and its relatively heavy crank mechanism during each operating cycle produces considerable bearing shock, a high degree of wear and generally unacceptably high noise levels. Further, the long ram stroke required to finish each nail limits the maximum attainable production speed of the machine.

The present invention is concerned with the aforedescribed general problems. Specifically, it is the general aim of the invention to provide an improved high speed nail making machine which operates at a relatively low noise level and delivers collated nails free of metal chip contamination, thereby eliminating need for additional chip separating and collating operations while facilitating additional cleaning and packaging operations as the collated finished nails leave the machine, should such additional operations be desired.

SUMMARY OF THE INVENTION

In accordance with the present invention, an improved nail making machine is provided which comprises a first workstation, and wire feeding means for delivering wire to the first workstation, wire cutting and pointing means at the first workstation for forming a pointed nail blank and severing the nail blank from the wire. The machine further includes a second workstation, nail blank conveying means for moving a nail blank from the first workstation to the second workstation, means for gripping and holding the nail blank at the second workstation, and heading means for forming a head on a nail blank held by the gripping and holding means.

DETAILED DESCRIPTION OF PREFERRED EMBODIMENT

Figures 1, 6:
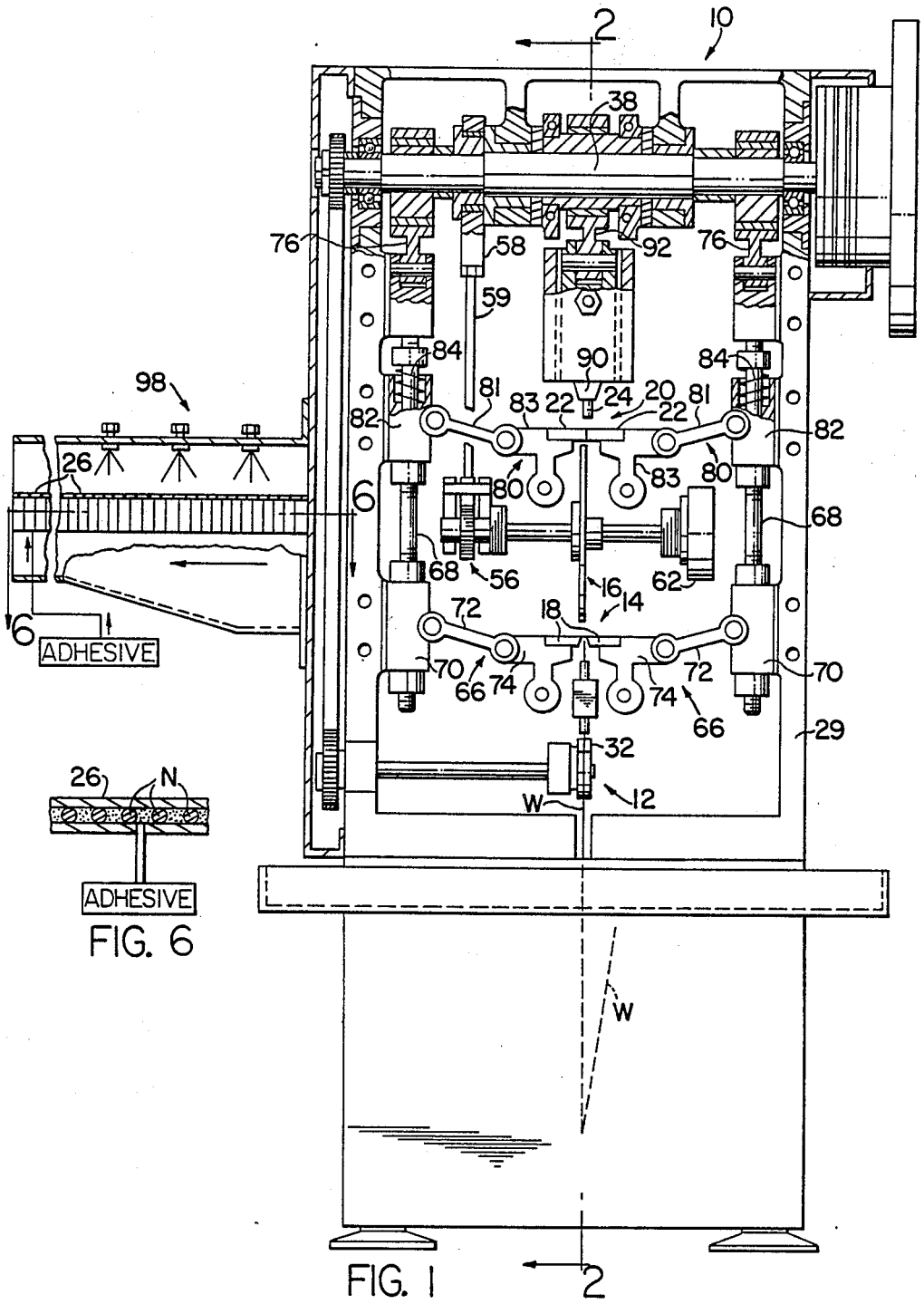
FIG. 1 is a somewhat schematic front elevational view of a nail making machine embodying the present invention.
FIG. 6 is a somewhat enlarged schematic fragmentary sectional view taken along the line 6—6 of FIG. 1.

Turning now to the drawings, a nail making machine embodying the present invention is indicated generally by the reference numeral 10. The illustrated machine 10 is particularly adapted to form headed nails from coiled wire W and includes a wire feeding mechanism, indicated generally at 12, for intermittently advancing an axially elongated wire in an axial direction to and through a first workstation, designated generally by the numeral 14, and into a rotary magazine or indexing wheel, indictated generally at 16. A pair of pointing and cutting dies 18,18, located at the first workstation or pointing and cutting station, simultaneously form and sever from the wire a nail blank having a pointed end and a free or blunt end, indicated by the letter B and defined by the end portion of the wire W received within the indexing wheel 16.

The nail blank B is conveyed by the indexing wheel 16 to a second workstation or heading station, indicated generally at 20, where a pair of gripping and holding jaws 22,22 grip the nail blank B in spaced relation to its blunt end and hold the blank while a ram driven heading tool 24 strikes a blow to the exposed free end portion projecting blunt end of the blank B to form a nailhead thereon. Upon completion of the heading operation the indexing wheel 16 feeds each finished nail, designated by the letter N, to a track 26 along which the nail moves while further finishing operations are or may be performed on it, all of which will be hereinafter more fully discussed.

Considering now the machine 10 in further detail, the wire W is payed off a spool or reel (not shown), and pulled through a roller straightener, such as indicated at 28 (FIG. 2) mounted on the machine frame 29, or, alternatively, through a wire sizing die (not shown), by a wire pulling capstan 30 (FIG. 2) around which several turns of the wire W is wrapped. Wire payed off the capstan 30 travels in a slack loop to a feed roll mechanism which includes a pair of feed rolls 32,32 located along the path of wire travel between the capstan 30 and the first workstation 14. The feed roll 32,32 operate to advance from the first workstation 14 and to the indexing wheel 16 a length of wire required to form a nail blank B.

Figure 3:
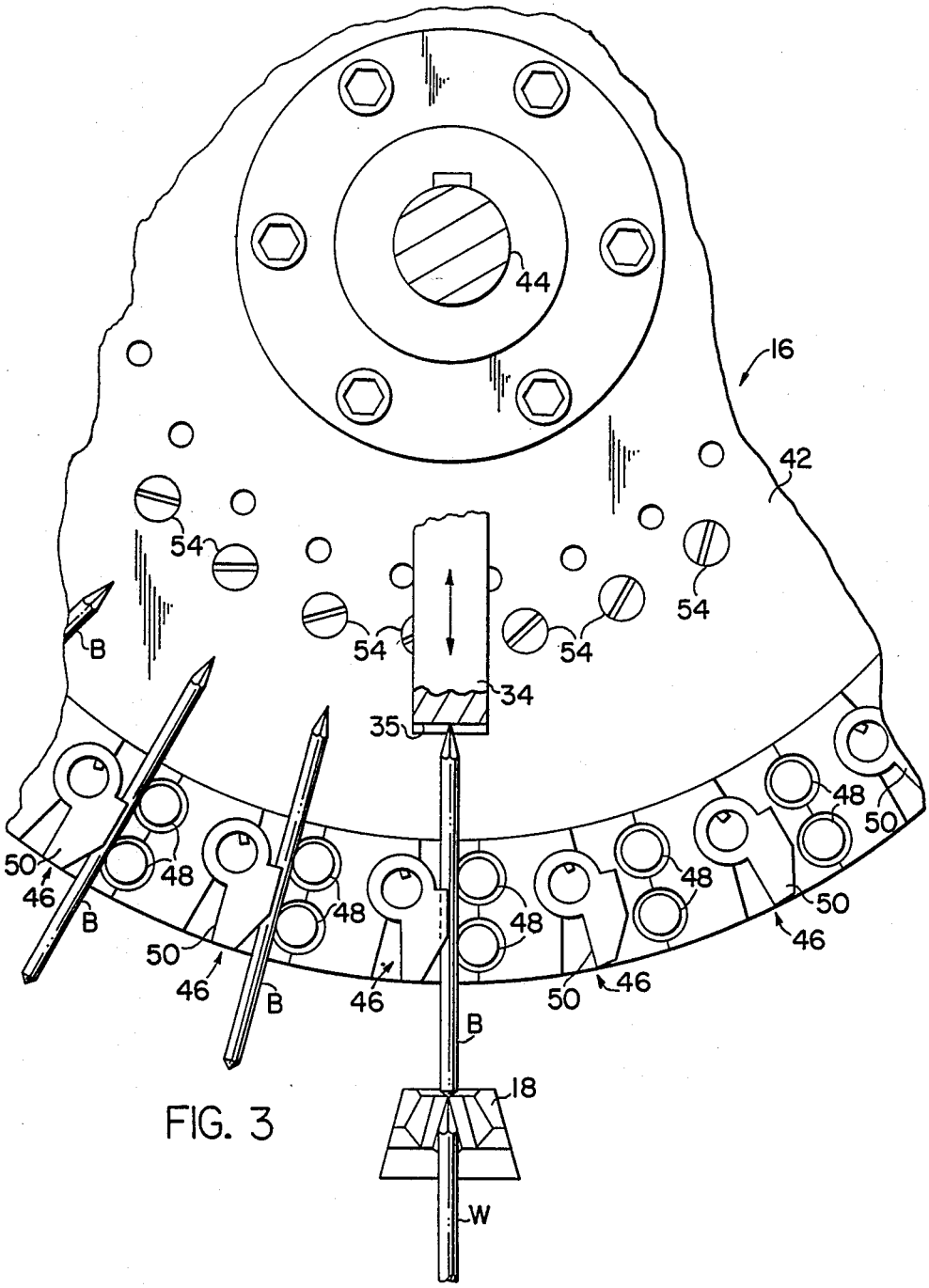
FIG. 3 is a somewhat enlarged fragmentary side elevational view showing the indexing wheel and a pointing and cutting die at the first workstation.

The feed rolls 32,32 are arranged in opposing relation to each other and are driven in opposite directions to engage opposite sides of the wire W as it passes therebetween. The feed roll mechanism is adjustable to vary the length of wire advanced during each rotation of the feed rolls. Specifically, each feed roll 32 has a peripheral sector for cooperating with the peripheral sector on the other feed roll to engage an associated portion of the wire W disposed therebetween during a portion of each revolution of the feed rolls. At least one of the feed rolls is angularly adjustable about its axis and relative to the other feed roll to vary the amount of cooperating contact which occurs between the feed roll sectors and the wire W during each revolution of the feed rolls, whereby the wire W is incrementally advanced a predetermined distance in the direction of the first workstation and the indexing wheel during each revolution of the feed rolls 32,32. The feed rolls 32,32, are preferably adjusted to deliver to the indexing wheel 16 a slightly greater length of wire than is required to form a nail blank B. A vertically adjustable stop 34 is mounted in fixed position relative to the machine frame and generally adjacent the indexing wheel 16 at the six o'clock position of the wheel and in the path of the advancing wire W, as shown in FIG. 3. The stop has an abuttment surface 35 at its lower end for engagement by the pointed end of the advancing wire W to halt wire advance, substantially as shown in FIG. 3. A vertically disposed guide tube 36 located between the feed rolls 32,32 and the first workstation 14 aids in maintaining proper alignment of the wire during the wire feeding operation.

A dancer mechanism located between the capstan 30 and the feed rolls 32,32 includes a pivoted dancer arm 37 responsive to demand for wire by the feed rolls 32,32. The dancer arm 37 operates a switch or the like (not shown) to activate the pulling capstan 30, in a manner well known in the art.

The feed rolls 32,32, the rotary magazine 16 and the tooling at the first and second workstations 14 and 20 are driven by a main crank shaft 38 journalled for rotation about a generally horizontal axis at the upper portion of the machine frame. A flywheel pulley mounted on one end of the crank shaft 38 is connected by a drive belt to an associated drive motor 40 mounted on the machine frame 29 which drives the crank shaft.

Figure 4:
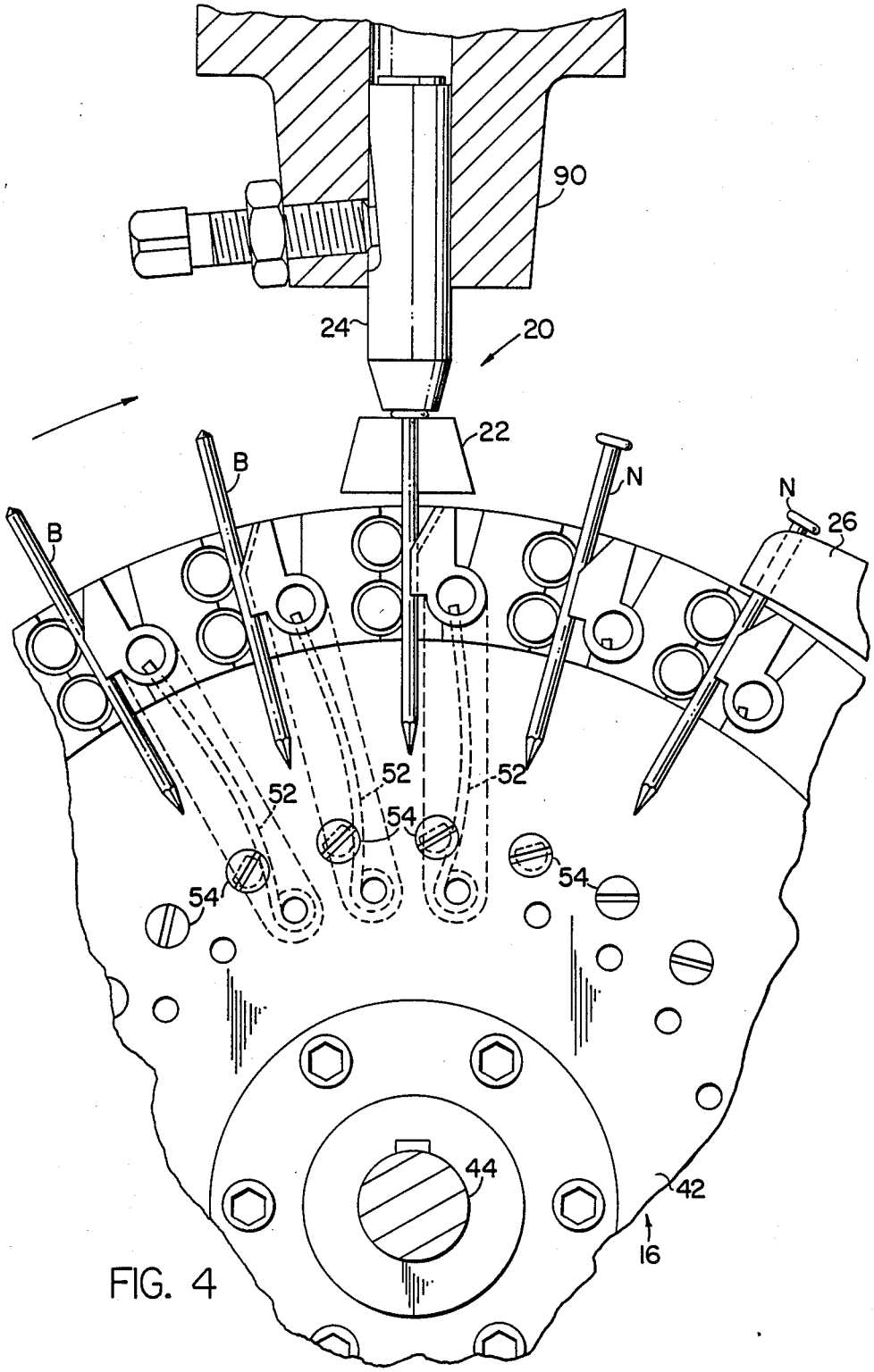
FIG. 4 is a somewhat enlarged fragmentary side elevational view of the indexing wheel showing a gripping jaw and the ram in heading engagement with a nail blank at the second workstation.

The rotary magazine or indexing wheel 16 generally comprises a circular disc 42 supported for rotation about an axis parallel to the axis of the crank shaft 38 by another shaft 44 keyed to the disc 42 and journalled for rotation on the machine frame. A plurality of nail blank holders, indicated generally at 46,46, are mounted on the disc 42 in equiangular circumaxially spaced relation to each other near the periphery of the disc. Each nail blank holder 46 includes a pair of parallel, generally cylindrical holding posts 48,48 mounted in fixed position on and projecting from one side of the disc 42 in radially spaced apart relation to each other. Each nail blank holder further includes a nail blank retaining member 50 pivotally supported at its inner end on the disc 42 generally adjacent the holding posts 48,48 for pivotal movement about an axis parallel to the axes of the posts. An elongated wire spring member 52 is mounted in cantilever position on the disc radially inward relative to each pair of posts 48,48 and adjacent the opposite side of the disc 42, as shown in FIG. 4. The outer end of each spring member 52 is received in a recess in the pivotal support at the inner end of an associated nail blank retaining member 50, substantially as shown in FIG. 4. Tension is applied to each spring member by an associated tensioning member 54 mounted near the inner end portion of the spring member 52. Each tensioning member 54 comprises a generally semi-cylindrical post having a diametrically disposed flat side and supported on the disc 42 for limited angular movement relative to the disc. Spring tension acting upon each nail blank retaining member 50 may be relaxed by rotating the associated tensioning member 54 about its axis and to a position wherein the flat side of the tensioning member is disposed adjacent the associated spring member. Tension is applied to the spring member by rotating the associated post 54 to the position shown in FIG. 4 wherein the tensioned spring member acts upon an associated nail blank retaining member 50 to bias it in a generally counter clockwise direction and toward the holding posts 48,48 as shown in FIGS. 3 and 4. Each nail blank retaining member 50 has a lead angle at its outer end and a groove of arcuate cross-section therein which cooperates with the holding posts to receive and releasably retain a nail blank B therebetween. The number of nail blank holders mounted on the disc 42 may vary, but in accordance with the presently preferred construction 24 nail blank holders 46,46 are provided which are equiangularly spaced about the center of the disc.

The indexing wheel 16 is incrementally advanced in clockwise direction, as it appears in FIGS. 3 and 4, by a ratchet and pawl mechanism, indicated generally at 56, (FIG. 1) actuated by upward movement of a generally vertically reciprocally movable pitman or connecting rod 58 driven by an associated eccentric on the crank shaft 38 and connected to the pawl of the mechanism 56 by a drive rod 59. The pawl engages a ratchet keyed to the indexing wheel shaft 44. A magnetic drag brake 62 coupled to the shaft 44 prevents indexing wheel override.

The pointing and cutting dies 18,18 for simultaneously forming a point on the wire W and severing a nail blank B from the wire are located at the first workstation 14 between the indexing wheel 16 and the feed rolls 32,32. The dies 18,18 are supported for pivotal movement about parallel horizontal axes generally toward and away from each other and into and out of engagement with opposite sides of a wire such as the wire W disposed therebetween. Driving force for closing the pointing and cutting dies on the wire is provided by a pair of toggle linkages 66,66 driven by a pair of vertically disposed push rods 68,68 supported at laterally opposite sides of the machine frame. Each push rod 68 has a lower slide block 70 mounted thereon and supported for vertical sliding movement on a fixed way associated with the machine frame. Each slide block 70 is secured to an associated push rod 68 between a pair of lock nuts threaded onto the push rod above and below the slide block, substantially as shown in FIG. 1. Thus, each slide block 70 may be adjustably positioned along its associated push rod 68 to adjust the opening and closing of its associated toggle linkage. Each toggle linkage 66 comprises a pair of connected links 72 and 74. Each link 74 carries an associated pointing and cutting die 18 and is pivotally supported on the machine frame, substantially as shown in FIG. 1. The push rods 68,68 are driven in unison by a pair of pitmans 76,76 driven by eccentrics on the crank shaft 38.

Figure 5:
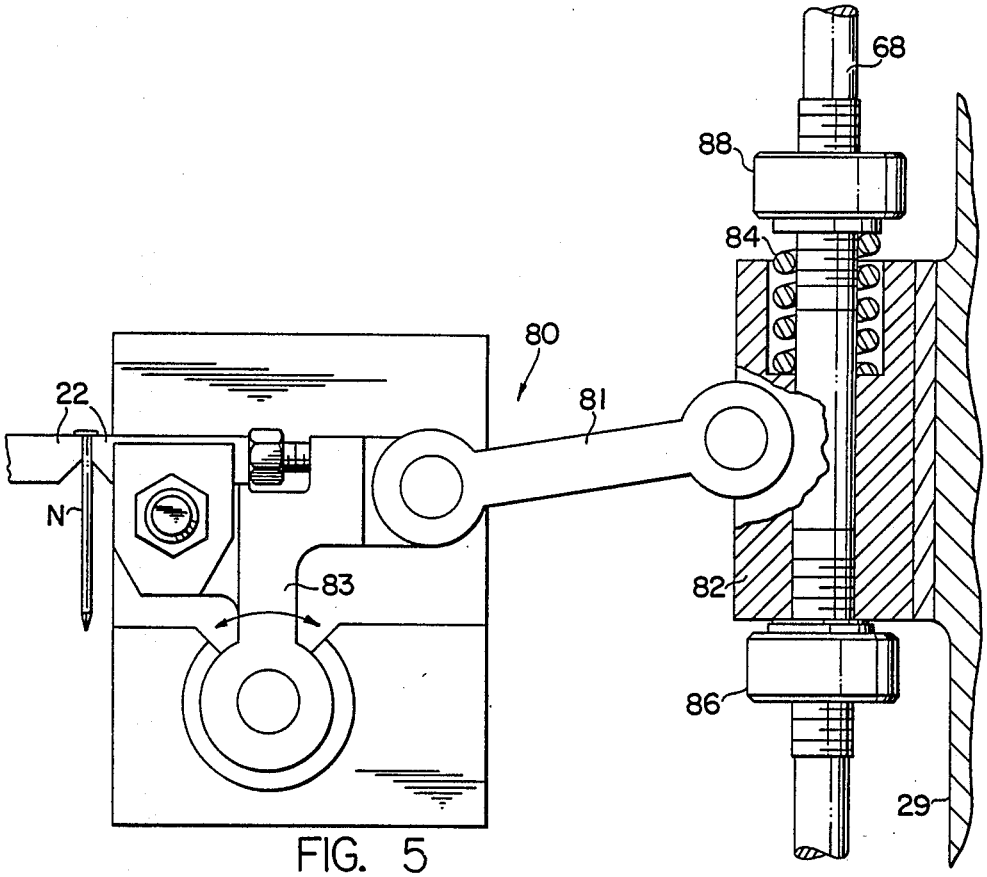
FIG. 5 is a somewhat enlarged fragmentary front elevational view of the machine showing the nail blank gripping and holding jaw mechanism.

The tooling at the second workstation 20 includes the gripping and holding jaws 22,22 which are supported for pivotal movement into and out of gripping engagement with opposite sides of a nail blank B positioned therebetween. The jaws 22,22 are driven by toggle linkages designated generally at 80,80 and generally similar to the previously described toggle linkages 66,66. Each toggle linkage 80 includes a pair of links 81 and 83 and is connected to an upper slide block 82 supported for vertical sliding movement by a way associated with the machine frame 29, as best shown in FIG. 5. Each upper slide block 82 is adjustably connected to an associated push rod 68 through a compression spring 84 by a pair of adjustment nuts 86 and 88 threaded onto the push rod, substantially as shown in FIG. 5, for a reason which will be hereinafter further apparent. Each jaw 22 is carried by an associated pivoted link 83.

The tooling at the second workstation 20 also includes the heading tool 24 which is adjustably secured to the lower end of a ram 90 supported for vertical reciprocal movement on the machine frame and attached to a connecting rod 92 driven by an eccentric on the crank shaft 38.

Figure 2:
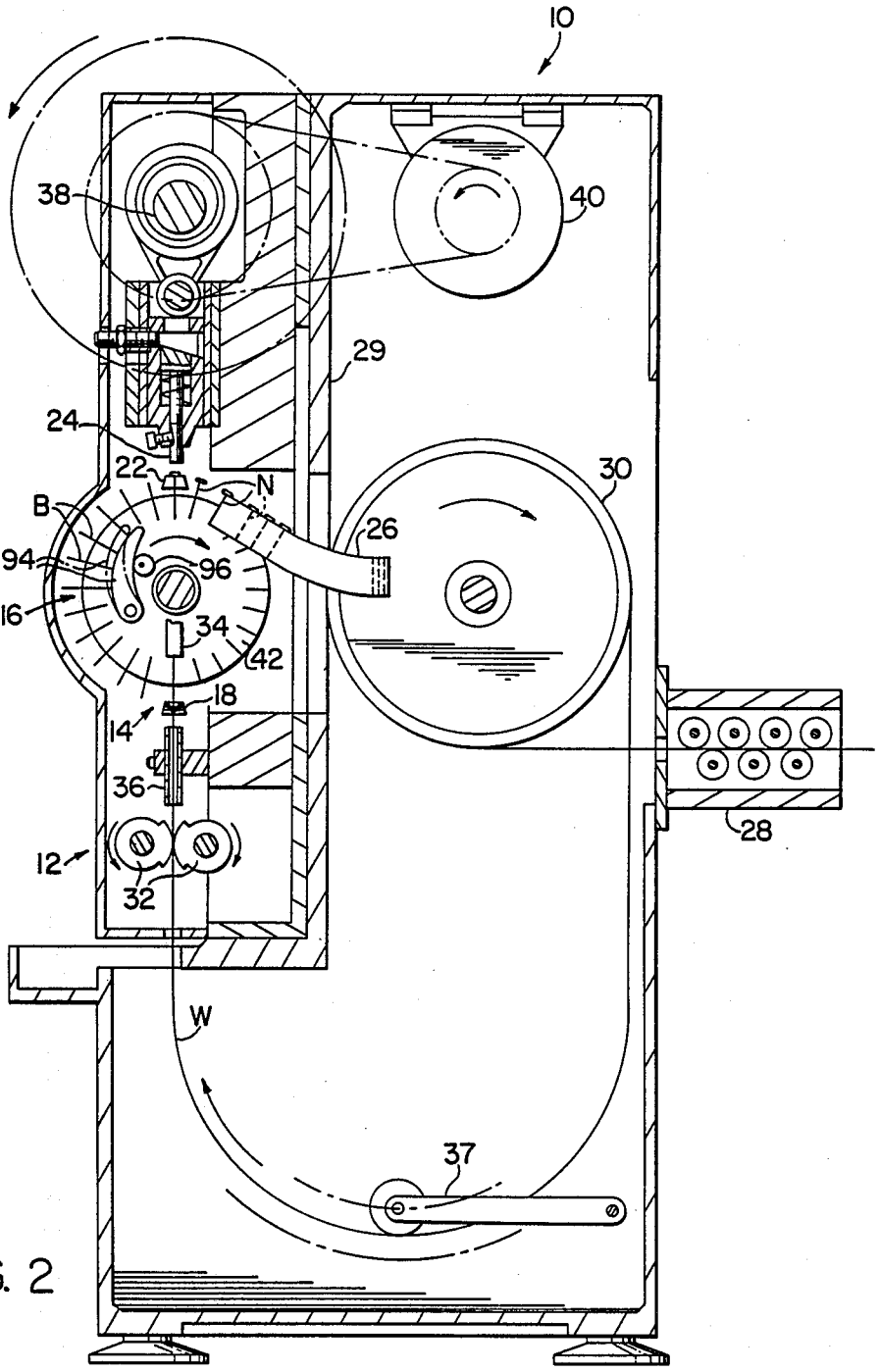
FIG. 2 is a somewhat schematic side elevational view taken generally along the line 2,2 of FIG. 1.

The size of the nail head produced by the heading tool 24 is determined by the amount of nail blank projection exposed above the jaws 22,22 and in the path of the heading tool 24. In accordance with the present invention the size of the nail head being produced may be changed while the machine 10 is in operation. For this purpose a head size adjustment cam 94 is supported on the machine frame generally adjacent the indexing wheel 16 for engaging the pointed inner ends of the nail blanks B,B as the nail blanks are conveyed from the first workstation 14 to the second workstation 16, as shown in FIG. 2. The cam 94 is pivoted at one end about an axis parallel to the axis of the indexing wheel shaft 44 and has an arcuate radially outwardly facing cam surface for engaging the pointed ends of the moving nail blanks, substantially as shown in FIG. 2. A manually operable means, such as a cam 96, shown in FIG. 2, is provided for altering the position of the head size adjustment cam 94 relative to the periphery of the indexing wheel 16 to determine the amount of nail blank projection beyond the periphery of the wheel 16 when each nail blank arrives at the second workstation 20.

At the beginning of a complete nail making cycle the ram driven heading tool 24 is in its raised or uppermost position, the pointing and cutting dies 18,18 and the gripping and holding jaws 22,22 are open, the indexing wheel 16 is at rest, the end portion of the wire W is positioned within a nail blank holder 46 at the six o'clock position, and nail blanks B,B are disposed in all of the other nail blank holders from the six o'clock to the twelve o'clock position of the wheel, shown in FIG. 2.

As the ram 24 descends the push rods 68,68 move downward to operate the toggle linkages 80,80 and which close the jaws 22,22 on an associated nail blank B and move the dies 18,18 into operating engagement with the wire W. The gripping and holding jaws 22,22 dwell in gripping engagement with the nail blank B therebetween while the push rods 68,68 continue to move downward against the biasing force of the compression springs 84,84 to pivot the dies 18,18 into pointing and cutting engagement with the wire W. The ram 24 simultaneously strikes a heading blow to the projecting blunt or free end portion of the nail blank B held between the jaws 22,22 to form a nail N from the latter nail blank. The force of this heading blow helps to close the toggle linkage which moves the gripping and holding jaws 22 into holding engagement with the nail blank B, thus increasing the holding force applied by the jaws which requiring minimum force from the push rods.

As the ram 24 ascends, the push rods move in upward directions operating the toggle linkages 66,66 and 80,80 to open the pointing and cutting dies 18,18 and the gripping and holding jaws 22,22. During upward movement of the ram 24 the ratchet and pawl mechanism 56 is actuated by the upwardly moving pitman 58 to move the indexing wheel 16 through a 15 degree angle whereby to position empty nail blank holder 46 at the six o'clock position and a nail blank B at the twelve o'clock position of the indexing wheel 16. When the indexing wheel comes to rest the feed rolls 32,32 advance the wire W upwardly between the open pointing and cutting dies 18,18 and into through the nail blank holder 46 at the twelve o'clock position. Movement of the wire W is arrested by engagement of the pointed end of the wire with the stop 34. The feed rolls 32,32 are adjusted to provide slight wire overtravel, as previously indicated, to assure positive engagement of the pointed end of the wire with the abuttment surface 35 on the stop.

As the indexing wheel 16 moves in clockwise direction from its position in the drawings, a finished nail at the twelve o'clock position of the wheel moves into the track 26. A portion of the track 26 near its nail receiving end is laterally offset away from the indexing wheel 16 causing each finished nail N to be pulled in a lateral direction out of its associated nail blank holder 46 as it moves into and along the track 26. The track is provided to collate or maintain the furnished nails in uniform orientation relative to each other as the finished nails advance to a point of egress from the machine. In the illustrated machine 10 the nails N,N are oriented in side-by-side relation and advance within the track 26 in response to line pressure exerted by other finished nails N,N therebehind.

Further operations may be performed on the uniformally oriented nails advancing within the track 26, and the illustrated machine 10 includes a spray apparatus indicated generally by the numeral 98 which sprays a suitable cleaning solution on the advancing nails (FIG. 1) for cleaning the nails prior to packaging.

Further, and in accordance with the invention, a brat of nails for use in an automatic nailing machine may be formed by attaching the nails together in side-by-side relation to each other as the nails move along the track 26. More specifically, a suitable adhesive such as a hot melt compound may be introduced into a section of the track to adhere each nail to an adjacent one as indicated somewhat schematically in FIG. 6. If necessary, the track section may be maintained in a heated condition when the nails are to be adhesively connected in the aforesaid manner.

Figure 7:
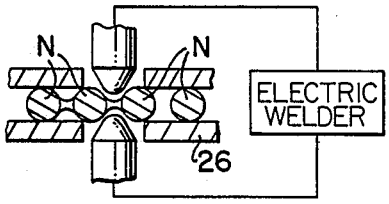
FIG. 7 is similar to FIG. 6 but shows another embodiment of the invention.

A suitable spot welding apparatus associated with the track 26 may also be provided for attaching nails in side-by-side relation to each other, if desired, as shown somewhat schematically in FIG. 7. The illustrated apparatus shown in FIG. 7 includes a pair of electrodes connected to an associated power source and between which the closely spaced nails are constrained to pass in traveling along the track 26.

Additional apparatus (not shown) may be provided for gluing paper strips to the nails before the nails leave the track, as, for example, where the nails are to be packaged for use in an automatic nailing machine or the like.

The capstan feeding mechanism controlled by the dancer arm minimizes back tension on the feeding rolls and assures smooth wire unreeling. The pulling capstan also enables provision of a wire callibrating drawing operation at the entrance end of the machine. The indexing wheel which delivers nail blanks to the heading station in a transverse direction relative to the direction of ram movement allows for a short ram stroke which permits high speed operation at relatively low noise levels. The pivoted toggle mechanism which closes the gripping and holding jaws cooperates with the ram to tighten the grip of the jaws on a nail blank during the heading operation. Further, the rotary magazine allows for the addition of a device for assembling washers on the nail blanks prior to the heading operation when such special nails are to be produced. The push rod operated toggle linkages enable substantially identical eccentric strokes for all machine functions which simplifies machine manufacture. Since the heading operation is performed at a workstation remote from the pointing and cut-off operation, the need for an additional operation to separate chips from finished nails is eliminated. Further, since the finished nails are collated or uniformally oriented in the machine additional workstations for performing operations which require uniformally oriented nails may easily be added to the machine.

I claim:

1. A nail making machine comprising a first workstation, wire feeding means for delivering an axially elongated wire having a free end to said first workstation, wire pointing and cutting means at said first workstation for forming a pointed nail blank from the wire and severing the pointed nail blank from the wire, a second workstation having a second station axis, nail blank conveying means for moving a nail blank from said first workstation to said second workstation and supporting the nail blank at said second workstation with a free end portion of the nail blank in a head forming position wherein the axis of the nail blank is coaxially aligned with said second station axis, heading means for delivering a head forming blow to the free end portion of a pointed nail blank supported in said forming position at said second workstation and including a ram supported for movement toward and into head forming engagement with the free end portion of a nail blank supported in said forming position and away from said second workstation, and gripping means for applying holding force to a pointed nail blank such as aforesaid to hold the nail blank in said forming position and increasing the holding force applied to the nail blank in response to movement of the ram into head forming engagement with the free end and including a pair of holding jaws disposed at laterally opposite sides of said second station axis, means for supporting said jaws for pivotal movement in opposite directions about laterally spaced apart pivot axes located at opposite sides of said second station axis and along a line normal to said second station axis and spaced from said jaws in a direction away from said ram along said second station axis, and means for pivoting said supporting means between a closed position wherein said jaws engage and hold a pointed nail blank such as aforesaid in said forming position and an open position wherein said jaws are out of holding engagement with a pointed nail blank.

2. A nail making machine as set forth in claim 1 wherein said means for moving said pointing and cutting dies comprises said means for pivoting said supporting means.

3. A nail making machine as set forth in claim 2 wherein said means for moving said pointing and cutting dies comprises a pair of push rods.

4. A nail making machine as set forth in claim 3 wherein said means for moving said pointing and cutting dies comprises a first pair of toggle linkages, said means for pivoting said gripping and holding jaws comprises a second pair of toggle linkages, and each of said toggle linkages is connected to an associated one of said push rods.

5. A nail making machine as set forth in claim 2 wherein said means for moving said pointing and cutting dies comprises said means for moving said ram assembly.

6. A nail making machine as set forth in claim 5 wherein said means for moving said pointing and cutting dies comprises a rotary crank shaft.

7. A nail making machine as set forth in claim 5 wherein said means for moving said pointing and cutting means comprises means for operating said wire feeding means.

8. A nail making machine as set forth in claim 7 wherein said means for moving said pointing and cutting means comprises means for indexably rotating said indexing wheel.

9. A nail making machine as set forth in claim 8 wherein said means for moving said pointing and cutting means comprises a rotary crank shaft.

10. A nail making machine as set forth in claim 1 wherein said wire feeding means comprises a wire pulling capstan.

11. A nail making machine as set forth in claim 10 wherein said wire feeding means includes means located along the path of wire travel from said capstan to said first workstation for receiving wire from said capstan and intermittently delivering wire to said first workstation.

12. A nail making machine as set forth in claim 1 wherein said means for feeding wire comprises a pair of opposing feed rolls for engaging opposite sides of a wire passing therebetween and adjusting means for varying the amount of wire advanced during each rotation of said feed rolls.

13. A nail making machine as set forth in claim 12 wherein the adjusting means comprises means for angularity adjusting the position of one of said feed rolls relative to the other of said feed rolls to alter the amount of simultaneous circumferential contact between said opposing feed rolls and the wire occuring during each revolution of said feed rolls.

14. A nail making machine as set forth in claim 1 wherein said nail blank conveying means comprising an indexing wheel and means for indexably rotating said indexing wheel.

15. A nail making machine as set forth in claim 14 wherein said first and second workstations are located at diametrically opposite sides of said indexing wheel.

16. A nail making machine as set forth in claim 1 including collating means receiving nails from said conveying means for defining a path along which nails advance in uniform orientation relative to each other.

17. A nail making machine as set forth in claim 16 wherein said collating means comprises a track.

18. A nail making machine as set forth in claim 16 including means for attaching each nail to an adjacent nail while the nails advance along said path.

19. A nail making machine as set forth in claim 18 wherein said means for attaching is farther characterized as means for spot welding each nail to an adjacent nail.

20. A nail making machine as set forth in claim 11 wherein said means for attaching is further characterized as means for adhering each nail to an adjacent nail.

21. A nail making machine comprising a head forming station having a station axis, means for delivering axially elongated nail wire to said head forming station in a head forming position wherein the axis of the nail wire is generally coaxially aligned with said station axis, gripping means for applying holding force to a nail wire in said forming position in spaced relation to the free end of the nail wire and including a pair of gripping and holding jaws having opposing jaw surfaces and disposed at laterally opposite sides of said station axis, means for supporting said jaws for pivotal movement in opposite directions about laterally spaced apart pivot axes located at laterally opposite sides of said station axis and along a line extending transversely of said station axis, and means for pivoting said supporting means between a holding position wherein said jaw surfaces engage nail wire in said forming position and an open position wherein said jaw surfaces are out of holding engagement with nail wire, and heading means including a ram supported for movement away from and toward said head forming station and into forming engagement with the free end portion of a nail wire in said head forming positions for forming a head on the exposed free end portion of nail wire supported in said forming position at said head forming station and simultaneously increasing the holding force applied to the nail wire by said gripping means as said ram moves into forming engagement with the free end portion of the nail wire.

22. A nail making machine as set forth in claim 21 including means for adjusting the spacing between said opposing jaw surfaces.

23. A nail making machine comprising a frame, an indexing wheel supported on said frame for rotational movement about a central axis fixed relative to said frame, a circumaxial series of equiangularly spaced nail blank holders carried by said indexing wheel, means for indexably rotating said indexing wheel about said central axis, first and second workstations disposed at diametrically opposite locations relative to said indexing wheel, wire feeding means for advancing an end portion of an axially elongated nail wire in an axial direction through said first workstation and into an associated one of said nail blank holders disposed at said first workstation, wire pointing and cutting means at said first workstation for pointing the wire and severing from the wire a pointed nail blank disposed within said one nail blank holder and having an exposed free end portion and including a pair of opposing pointing and cutting dies supported for pivotal movement on said frame and means for moving said dies in opposite directions toward each other and into pointing and cutting engagement with a nail wire such as the aforesaid, heading means at said second workstation for forming a head on the free end of a nail blank such as aforesaid disposed within another of said nail blank holders at said second workstation and including a ram assembly supported on said frame at said second workstation and means for moving said ram assembly relative to said frame and into head forming engagement with the free end portion of the nail blank in said other nail blank holder, and gripping means for applying holding force to the nail blank in said other nail blank holder in spaced relation to the free end thereof and increasing said holding force in response to movement of the ram into head forming engagement with the free end portion and including a pair of gripping and holding jaws disposed at laterally opposite sides of said second workstation and means for supporting said jaws for pivotal movement in opposite directions about laterally spaced apart parallel pivot axes located at opposite sides of said second workstation and along a line normal to and extending transversely of said second workstation axis and longitudinally spaced from said jaws and means for pivoting said supporting means between a closed position wherein said jaws are disposed in holding engagement with a pointed nail blank such as aforesaid within said other nail blank holder and an open position wherein said jaws are out of holding engagement with a pointed nail blank.

24. A nail making machine as set forth in claim 23 wherein said means for indexably rotating said indexing wheel, said means for moving said dies, said means for moving said jaws and said means for moving said ram comprises a crank shaft journalled for rotation on said frame in generally axially parallel relation to said central axis.

25. A nail making machine as set forth in claim 24 wherein said means for moving said dies and said means for moving said jaws comprises a pair of push rods supported for reciprocal movement relative to said frame and a pair of connecting rods for driving said push rods in response to rotation of said crank shaft.

26. A nail making machine as set forth in claim 25 including means for allowing said jaws to dwell in gripping and holding engagement with the nail blank in said other nail blank holder while said push rods continue to move said dies into pointing and cutting relation to the wire.

27. A nail making machine as set forth in claim 26 wherein said means for allowing said jaws to dwell comprise springs connected between said push rods and said jaws.

28. A nail making machine as set forth in claim 24 wherein said means for indexably rotating said indexing wheel comprises a ratchet and pawl mechanism operated by an associated connecting rod driven by said crank shaft.

29. A nail making machine as set forth in claim 25 wherein said ram assembly comprises a reciprocally movable ram.

* * * * *